US006081194A

United States Patent [19]

Sanchez

[11] Patent Number: 6,081,194

[45] Date of Patent: Jun. 27, 2000

[54] SIGNAL TRANSMITTING AND RECEIVING BRACELET SYSTEM

[76] Inventor: Gloria Sanchez, 4540 Lark Ellen Ave. #25, Covina, Calif. 91722

[21] Appl. No.: 09/234,660

[22] Filed: Jan. 21, 1999

[51] Int. Cl.[7] ..... G08B 23/00

[52] U.S. Cl. ..... 340/573.1; 340/573.6; 600/503

[58] Field of Search ..... 340/573.1, 573.6, 340/539; 600/500, 502, 503; 128/903

[56] References Cited

U.S. PATENT DOCUMENTS

| | | | |
|---|---|---|---|
| 3,838,684 | 10/1974 | Manuel et al. | 600/503 |
| 4,549,169 | 10/1985 | Moura et al. | 340/573.1 |
| 4,819,860 | 4/1989 | Hargrove et al. | 340/573.4 X |
| 5,319,355 | 6/1994 | Russek | 340/573.1 |
| 5,416,468 | 5/1995 | Baumann | 340/573.1 |
| 5,423,574 | 6/1995 | Forte-Pathroff | 283/75 |
| 5,897,506 | 4/1999 | Cohn | 600/503 X |
| 5,917,415 | 6/1999 | Atlas | 340/575 |

*Primary Examiner*—Thomas Mullen

[57] ABSTRACT

A signal transmitting and receiving bracelet system for notifying a user wearing a receiving bracelet that a user wearing a transmitting bracelet is in danger. The signal transmitting and receiving bracelet system includes a transmitting bracelet that has sensing and transmitting circuitry having a pressure transducer adapted for contacting a pulse point of a wrist of a user for sensing a pulse of a user. The sensing and transmitting circuitry also has a transmitter that is electrically connected to the pressure transducer to emit a first signal when a user's pulse rate is higher than a predetermined rate. A receiving bracelet has receiving circuitry with a receiver adapted for receiving signals emitted from the transmitting bracelet. The receiving circuitry has a sound emitting device that is electrically connected to the receiver for emitting a sound when a signal is received from the transmitting bracelet.

12 Claims, 2 Drawing Sheets

SIGNAL TRANSMITTING AND RECEIVING BRACELET SYSTEM

BACKGROUND OF THE INVENTION

1. Field of the Invention

The present invention relates to bracelets and more particularly pertains to a new signal transmitting and receiving bracelet system for notifying a user wearing a receiving bracelet that a user wearing a transmitting bracelet is in danger.

2. Description of the Prior Art

The use of bracelets is known in the prior art. More specifically, bracelets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,228,449; U.S. Pat. No. 4,305,143; U.S. Pat. No. 5,486,814; U.S. Pat. No. 5,097,254; U.S. Pat. No. 5,619,187; and U.S. Pat. No. 3,810,146.

While these devices fulfill their respective, particular objectives and requirements, the aforementioned patents do not disclose a new signal transmitting and receiving bracelet system. The inventive device includes a transmitting bracelet that has sensing and transmitting circuitry having a pressure transducer adapted for contacting a pulse point of a wrist of a user for sensing a pulse of a user. The sensing and transmitting circuitry also has a transmitter that is electrically connected to the pressure transducer to emit a first signal when a user's pulse rate is higher than a predetermined rate. A receiving bracelet has receiving circuitry with a receiver adapted for receiving signals emitted from the transmitting bracelet. The receiving circuitry has a sound emitting device that is electrically connected to the receiver for emitting a sound when a signal is received from the transmitting bracelet.

In these respects, the signal transmitting and receiving bracelet system according to the present invention substantially departs from the conventional concepts and designs of the prior art, and in so doing provides an apparatus primarily developed for the purpose of notifying a user wearing a receiving bracelet that a user wearing a transmitting bracelet is in danger.

SUMMARY OF THE INVENTION

In view of the foregoing disadvantages inherent in the known types of bracelets now present in the prior art, the present invention provides a new signal transmitting and receiving bracelet system construction wherein the same can be utilized for notifying a user wearing a receiving bracelet that a user wearing a transmitting bracelet is in danger.

The general purpose of the present invention, which will be described subsequently in greater detail, is to provide a new signal transmitting and receiving bracelet system apparatus and method which has many of the advantages of the bracelets mentioned heretofore and many novel features that result in a new signal transmitting and receiving bracelet system which is not anticipated, rendered obvious, suggested, or even implied by any of the prior art bracelets, either alone or in any combination thereof.

To attain this, the present invention generally comprises a transmitting bracelet that has sensing and transmitting circuitry having a pressure transducer adapted for contacting a pulse point of a wrist of a user for sensing a pulse of a user. The sensing and transmitting circuitry also has a transmitter that is electrically connected to the pressure transducer to emit a first signal when a user's pulse rate is higher than a predetermined rate. A receiving bracelet has receiving circuitry with a receiver adapted for receiving signals emitted from the transmitting bracelet. The receiving circuitry has a sound emitting device that is electrically connected to the receiver for emitting a sound when a signal is received from the transmitting bracelet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new signal transmitting and receiving bracelet system apparatus and method which has many of the advantages of the bracelets mentioned heretofore and many novel features that result in a new signal transmitting and receiving bracelet system which is not anticipated, rendered obvious, suggested, or even implied by any of the prior art bracelets, either alone or in any combination thereof.

It is another object of the present invention to provide a new signal transmitting and receiving bracelet system which may be easily and efficiently manufactured and marketed.

It is a further object of the present invention to provide a new signal transmitting and receiving bracelet system which is of a durable and reliable construction.

An even further object of the present invention is to provide a new signal transmitting and receiving bracelet system which is susceptible of a low cost of manufacture with regard to both materials and labor, and which accordingly is then susceptible of low prices of sale to the consuming public, thereby making such signal transmitting and receiving bracelet system economically available to the buying public.

Still yet another object of the present invention is to provide a new signal transmitting and receiving bracelet system which provides in the apparatuses and methods of the prior art some of the advantages thereof, while simultaneously overcoming some of the disadvantages normally associated therewith.

Still another object of the present invention is to provide a new signal transmitting and receiving bracelet system for notifying a user wearing a receiving bracelet that a user wearing a transmitting bracelet is in danger.

Yet another object of the present invention is to provide a new signal transmitting and receiving bracelet system which includes a transmitting bracelet that has sensing and transmitting circuitry having a pressure transducer adapted for contacting a pulse point of a wrist of a user for sensing a pulse of a user. The sensing and transmitting circuitry also has a transmitter that is electrically connected to the pressure transducer to emit a first signal when a user's pulse rate is higher than a predetermined rate. A receiving bracelet has receiving circuitry with a receiver adapted for receiving signals emitted from the transmitting bracelet. The receiving circuitry has a sound emitting device that is electrically connected to the receiver for emitting a sound when a signal is received from the transmitting bracelet.

Still yet another object of the present invention is to provide a new signal transmitting and receiving bracelet system that alerts parent or caregiver the moment trouble arises, allowing them to alert lifeguard or safety personnel in time for rescue.

Even still another object of the present invention is to provide a new signal transmitting and receiving bracelet system that sends a distress signal even if the individual in danger is too weak or otherwise unable to signal for the help they need.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
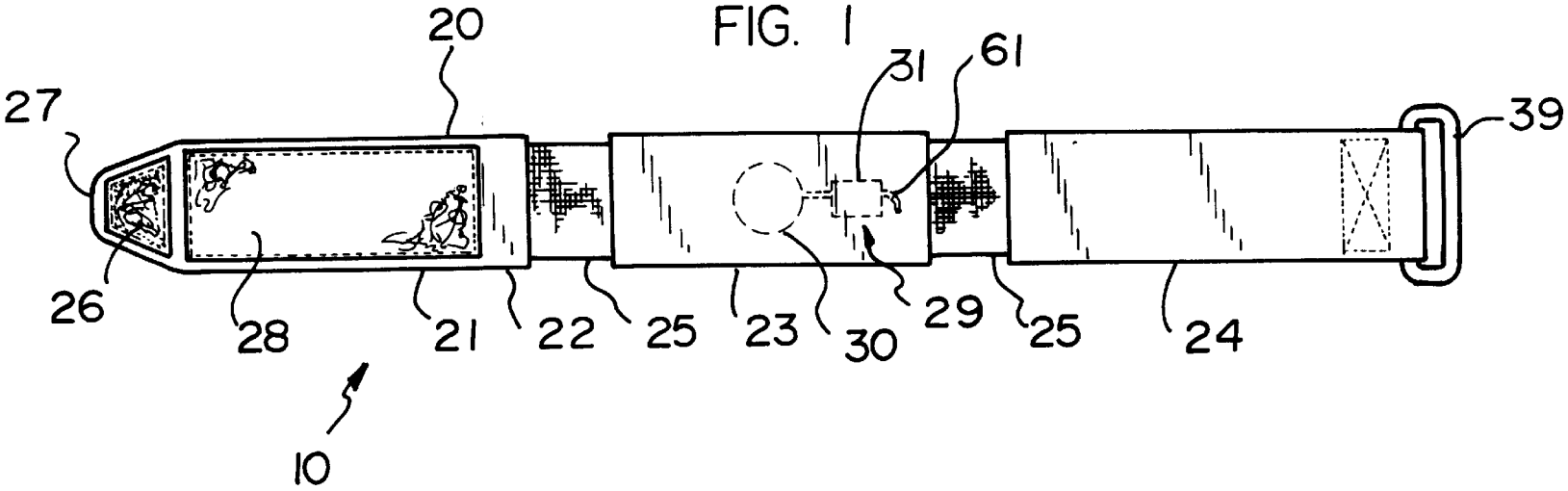
FIG. 1 is a schematic side view of a new signal transmitting and receiving bracelet system according to the present invention to be worn by a swimmer.
Figure 2:
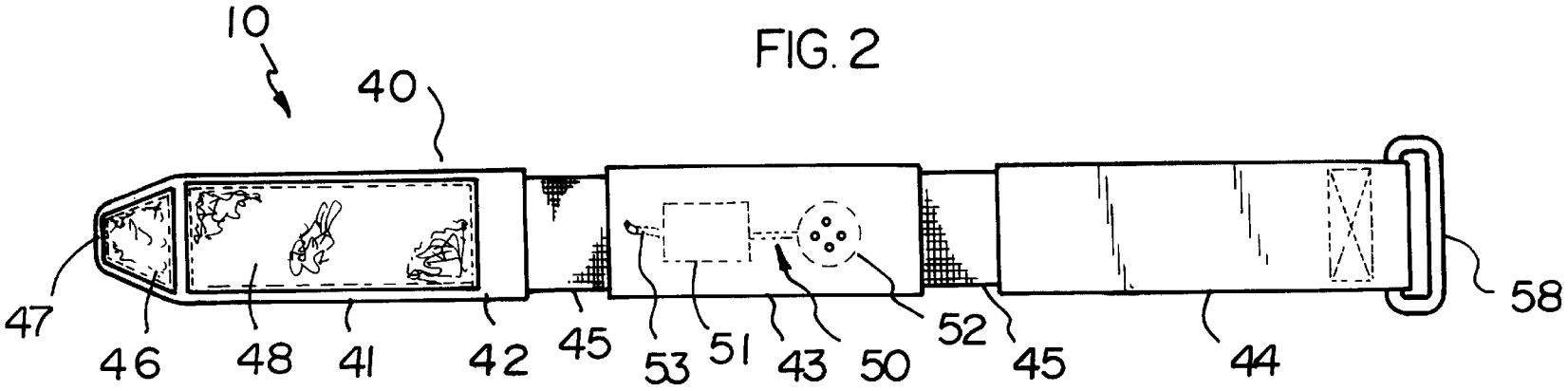
FIG. 2 is a schematic side view of the present invention to be worn by a person accompanying a swimmer.
Figure 3:
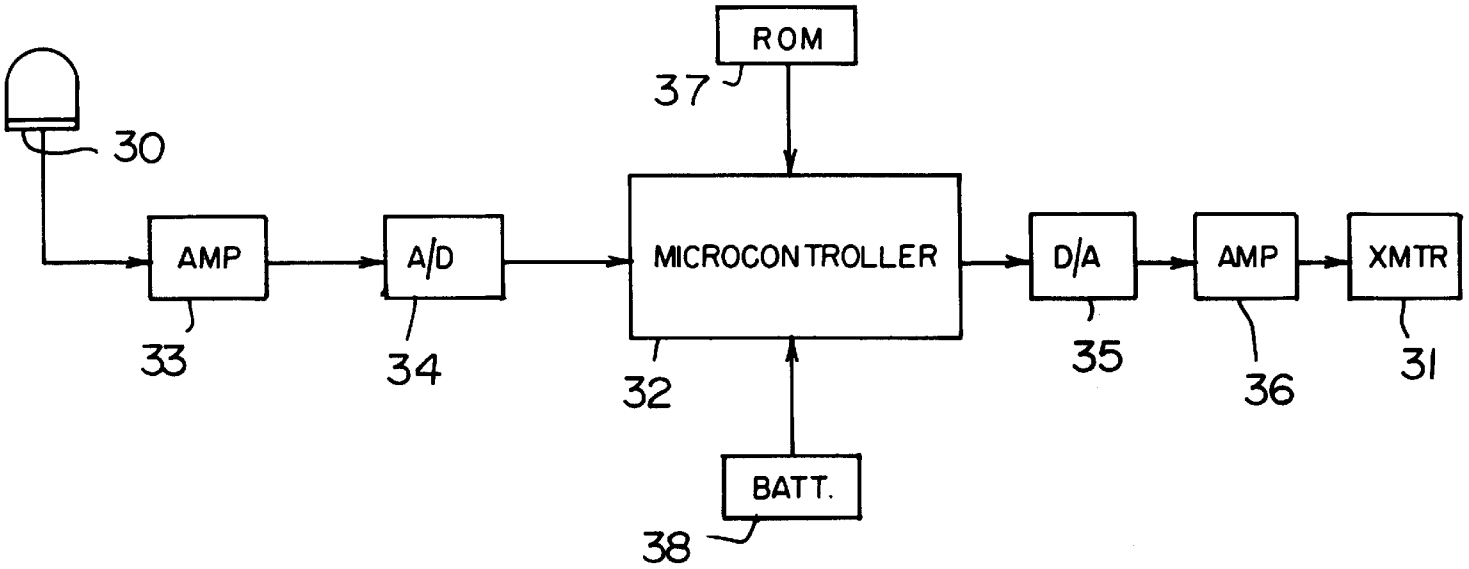
FIG. 3 is a schematic diagram of the portion of the present invention worn by the swimmer.
Figure 4:
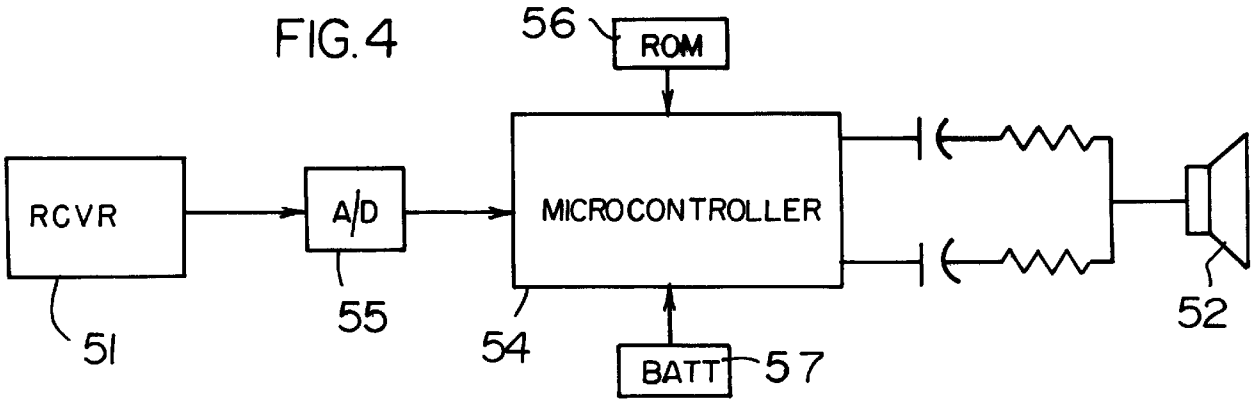
FIG. 4 is a schematic diagram of the portion of the present invention worn by swimmer.

With reference now to the drawings, and in particular to FIGS. 1 through 4 thereof, a new signal transmitting and receiving bracelet system embodying the principles and concepts of the present invention and generally designated by the reference numeral 10 will be described.

As best illustrated in FIGS. 1 through 4, the signal transmitting and receiving bracelet system 10 generally comprises a transmitting bracelet 20 and a receiving bracelet 40. The transmitting bracelet is worn by a swimmer. The receiving bracelet is worn by a caregiver, guardian, companion, or the like. If the swimmer gets in trouble while swimming, the transmitting bracelet will respond to the changes in the swimmer's pulse and send a signal to the receiving bracelet, which will emit an audio response to notify the wearer of the receiving bracelet that the swimmer is in trouble.

The transmitting bracelet has a strap 21 adapted for wrapping around a wrist of a user. Preferably, the strap is elastic to help keep the strap tight around a user's wrist so that the pressure transducer stays tight against the pulse point, regardless of shrinkage or expansion of the user's arm. In one embodiment of the strap, the strap has spaced apart first, second, and third portions 22,23,24 and a pair of elastic bands 25 coupling the portions together.

The first portion of the strap has one portion 26 (i.e., a hooks or loops portion) of a hooks and loops fastener coupled to it towards its free end 27. The first portion of the strap has also a complementary portion 28 of a hooks and loops fastener coupled to it and positioned between the one portion of the hooks and loops fastener and the second portion of the strap on the same side of the first portion such that folding of the free end of the first portion back on itself permits coupling of the portions of the hooks and loops fastener together.

The second portion of the strap has sensing and transmitting circuitry 29 with a pressure transducer 30 adapted for contacting a pulse point of a wrist of a user for sensing a pulse of a user. The pulse point is the point where a person's pulse may be detected, usually on the inside of the wrist. The pressure transducer emits electrical signals corresponding to the pulse rate of the wearer.

The sensing and transmitting circuitry has a transmitter 31 that is electrically connected to the pressure transducer for emitting a first signal when a user's pulse rate is higher than a predetermined rate. Preferably, the transmitter also emits a second signal when a user's pulse rate is lower than a predetermined rate. Ideally, the transmitter includes an antenna 61 to bolster signal strength.

Preferably, the sensing and transmitting circuitry has a controller 32 that takes an average of voltage levels coming from the pressure transducer and corresponding to a pulse rate. The controller sends a primary signal to the transmitter when the voltage levels are higher than a predetermined level for a predetermined amount of time, indicating a panic situation, and sends a secondary signal to the transmitter when the voltage levels are lower than a predetermined level for a predetermined amount of time, indicating that the wearer is losing or has lost consciousness.

Ideally, the controller ignores a predetermined number of maximum and minimum values for a predetermined amount of time, such as the two highest and lowest readings every 20 seconds. This compensates for error due to muscle movement and the like.

Optionally, the sensing and transmitting circuitry has a first amplifier 33 for amplifying the signal from the pressure transducer to the controller. The sensing and transmitting circuitry may also have a first converter 34 for converting the signal from the pressure transducer to the controller from analog to digital.

The sensing and transmitting circuitry may have a second converter 35 for converting the signal from the controller to the transmitter from digital to analog. The sensing and transmitting circuitry may also have a second amplifier 36 for amplifying the signal from the controller to the transmitter.

Preferably, the sensing and transmitting circuitry has a memory module 37 that is in communication with the controller. The memory module contains instructions for the controller. Ideally, the memory module is removable so that the memory module may be exchanged with another memory module with instructions based on a different swimmer.

Also preferably, the sensing and transmitting circuitry has a power source 38 such as a battery.

The third portion of the strap has a fastening loop 39 such that the free end of the first portion of the strap is insertable through the loop for fastening the first portion to the third portion to couple the strap to a wrist of a user.

The receiving bracelet is worn by someone other than the swimmer. Following is a description of the receiving bracelet and its interaction with the transmitting bracelet.

The receiving bracelet 40 includes a strap 41 adapted for wrapping around a wrist of a second user and may have spaced apart first, second, and third portions 42,43,44 and a pair of elastic bands 45 coupling the portions together. Like the transmitting bracelet, the elastic bands help keep the strap tight around a user's wrist, regardless of shrinkage or expansion of the user's arm.

The first portion of the strap may have one portion 46 (i.e., a hooks or loops portion) of a hooks and loops fastener coupled thereto towards a free end 47 thereof. The first portion of the strap would also have a complementary portion 48 of a hooks and loops fastener coupled thereto and positioned between the hooks portion and the second portion of the strap on the same side of the first portion such that folding of the free end of the first portion back on itself permits coupling of the portions of the hooks and loops fastener together.

The second portion of the strap has receiving circuitry 50 including a receiver 51 adapted for receiving signals emitted from the transmitting bracelet. The receiving circuitry has a sound emitting device 52 such as a speaker that is electrically connected to the receiver for emitting a sound when a signal is received from the transmitting bracelet. The sound emitting device emits a distinct first sound when the first signal is received from the transmitting bracelet and a distinct second sound when the second signal is received from the transmitting bracelet.

Preferably, the receiver includes an antenna 53 to bolster signal reception. Also preferably, the receiving circuitry has a controller 54 for monitoring the receiver for signals. The controller activates the sound emitting device when the receiver receives a signal from the transmitting bracelet.

The receiving circuitry may have a first converter 55 for converting the signal from the receiver to the controller from analog to digital. The receiving circuitry may also have a memory module 56 that is in communication with the controller. The memory module would contain instructions. Preferably, the receiving circuitry has a power source 57 such as a battery.

The third portion of the strap has a fastening loop 58. The free end of the first portion of the strap is insertable through the loop for fastening the first portion to the third portion for coupling the strap to a wrist of a user.

In use, the transmitting bracelet is put on by a swimmer. The receiving bracelet is put on by a second person. If the swimmer gets in trouble while swimming, the transmitting bracelet will respond to the changes in the swimmer's pulse and send a signal to the receiving bracelet, which will emit an audio response to notify the wearer of the receiving bracelet that the swimmer is in trouble.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bracelet system for notifying a user wearing a receiving bracelet that a user wearing a transmitting bracelet is in danger, comprising, in combination:

a transmitting bracelet, comprising:

a strap adapted for wrapping around a wrist of a user;

said strap having sensing and transmitting circuitry having a pressure transducer adapted for contacting a pulse point of a wrist of a user for sensing a pulse of a user, said pressure transducer emitting electrical signals corresponding to the pulse rate of the wearer; and said sensing and transmitting circuitry having a transmitter being electrically connected to said pressure transducer for emitting a first signal when a user's pulse rate is higher than a predetermined rate; and a receiving bracelet, comprising:

a strap adapted for wrapping around a wrist of a second user;

said strap having receiving circuitry having a receiver adapted for receiving signals emitted from said transmitting bracelet; and said receiving circuitry having a sound emitting device being electrically connected to said receiver for emitting a sound when a signal is received from said transmitting bracelet.

2. The bracelet system of claim 1, wherein said transmitter of said transmitting bracelet emits a second signal when a user's pulse rate is lower than a predetermined rate.

3. The bracelet system of claim 2, wherein said sound emitting device of said receiving bracelet emits a distinct second sound when said second signal is received from said transmitting bracelet.

4. The bracelet system of claim 1, wherein said transmitter of said transmitting bracelet includes an antenna.

5. The bracelet system of claim 1, wherein said sensing and transmitting circuitry of said transmitting bracelet has a controller for taking an average of voltage levels coming from said pressure transducer and corresponding to a pulse rate, said controller sending a primary signal to said transmitter when the voltage levels are higher than a predetermined level for a predetermined amount of time, said controller sending a secondary signal to said transmitter when the voltage levels are lower than a predetermined level for a predetermined amount of time.

6. The bracelet system of claim 5, wherein said controller ignores a predetermined number of maximum and minimum values for a predetermined amount of time.

7. The bracelet system of claim 5, wherein said sensing and transmitting circuitry has a memory module being in communication with said controller, said memory module containing instructions.

8. The bracelet system of claim 7, wherein said memory module is removable.

9. The bracelet system of claim 1, wherein said sound emitting device of said receiving bracelet emits a distinct first sound when said first signal is received from said transmitting bracelet.

10. The bracelet system of claim 1, wherein said receiver of said receiving bracelet includes an antenna.

11. The bracelet system of claim 1, wherein said receiving circuitry of said receiving bracelet has a controller for monitoring said receiver for signals, said controller activating said speaker when said receiver receives a signal from said transmitting bracelet.

12. A bracelet system for notifying a user wearing a receiving bracelet that a user wearing a transmitting bracelet is in danger, comprising, in combination:

a transmitting bracelet, comprising:

a strap adapted for wrapping around a wrist of a user and having spaced apart first, second, and third portions and a pair of elastic bands coupling said portions together;

said first portion of said strap having one portion of a hooks and loops fastener coupled thereto towards a free end thereof;

said first portion of said strap having a complementary portion of a hooks and loops fastener coupled thereto and positioned between said one portion and said second portion of said strap such that folding of the free end of the first portion back on itself permits coupling of said portions of said hooks and loops fastener together;

said second portion of said strap having sensing and transmitting circuitry having a pressure transducer adapted for contacting a pulse point of a wrist of a user for sensing a pulse of a user, said pressure transducer emitting electrical signals corresponding to the pulse rate of the wearer;

said sensing and transmitting circuitry having a transmitter being electrically connected to said pressure transducer for emitting a first signal when a user's pulse rate is higher than a predetermined rate;

said transmitter emitting a second signal when a user's pulse rate is lower than a predetermined rate;

said transmitter including an antenna;

said sensing and transmitting circuitry having a controller for taking an average of voltage levels coming from said pressure transducer and corresponding to a pulse rate, said controller sending a primary signal to said transmitter when the voltage levels are higher than a predetermined level for a predetermined amount of time, said controller sending a secondary signal to said transmitter when the voltage levels are lower than a predetermined level for a predetermined amount of time;

wherein said controller ignores a predetermined number of maximum and minimum values for a predetermined amount of time;

said sensing and transmitting circuitry having a first amplifier for amplifying said signal from said pressure transducer to said controller;

said sensing and transmitting circuitry having a first converter for converting said signal from said pressure transducer to said controller from analog to digital;

said sensing and transmitting circuitry having a second converter for converting said signal from said controller to said transmitter from digital to analog;

said sensing and transmitting circuitry having a second amplifier for amplifying said signal from said controller to said transmitter;

said sensing and transmitting circuitry having a memory module being in communication with said controller, said memory module containing instructions;

wherein said memory module is removable;

said sensing and transmitting circuitry having a power source;

said third portion of said strap having a fastening loop, said free end of said first portion of said strap being insertable through said loop for fastening said first portion to said third portion for coupling said strap to a wrist of a user;

a receiving bracelet, comprising:

a strap adapted for wrapping around a wrist of a second user and having spaced apart first, second, and third portions and a pair of elastic bands coupling said portions together;

said first portion of said strap having one portion of a hooks and loops fastener coupled thereto towards a free end thereof;

said first portion of said strap having a complementary portion of a hooks and loops fastener coupled thereto and positioned between said one portion and said second portion of said strap such that folding of the free end of the first portion back on itself permits coupling of said portions of said hooks and loops fastener together;

said second portion of said strap having receiving circuitry having a receiver adapted for receiving signals emitted from said transmitting bracelet;

said receiving circuitry having a sound emitting device being electrically connected to said receiver for emitting a sound when a signal is received from said transmitting bracelet;

said sound emitting device emitting a distinct first sound when said first signal is received from said transmitting bracelet;

said sound emitting device emitting a distinct second sound when said second signal is received from said transmitting bracelet;

said receiver including an antenna;

said receiving circuitry having a controller for monitoring said receiver for signals, said controller activating said sound emitting device when said receiver receives a signal from said transmitting bracelet;

said receiving circuitry having a first converter for converting said signal from said receiver to said controller from analog to digital;

said receiving circuitry having a memory module being in communication with said controller, said memory module containing instructions;

said receiving circuitry having a power source; and said third portion of said strap having a fastening loop, said free end of said first portion of said strap being insertable through said loop for fastening said first portion to said third portion for coupling said strap to a wrist of a user.

* * * * *